United States Patent [19]

Nishi et al.

[11] Patent Number: 4,976,918

[45] **Date of Patent: * Dec. 11, 1990**

[54] ALUMINUM DIE-CASTING ALLOYS

[75] Inventors: Naomi Nishi; Shigetake Kami, both of Tokyo; Takashi Yamaguchi, Hiroshima, all of Japan

[73] Assignee: Ryobi Limited, Tokyo, Japan

[ * ] Notice: The portion of the term of this patent subsequent to Jul. 11, 2006 has been disclaimed.

[21] Appl. No.: 351,886

[22] Filed: May 15, 1989

Related U.S. Application Data

[63] Continuation of Ser. No. 76,435, Jul. 21, 1987, Pat. No. 4,847,048.

[30] Foreign Application Priority Data

| | | | |
|---|---|---|---|
| Jul. 21, 1986 | [JP] | Japan | 61-171169 |
| Jan. 19, 1987 | [JP] | Japan | 62-10823 |
| Apr. 7, 1987 | [JP] | Japan | 62-86416 |
| Jun. 3, 1987 | [JP] | Japan | 62-140431 |

[51] Int. Cl.[5] ..... C22C 21/00

[52] U.S. Cl. ..... 420/546; 148/415; 420/547

[58] Field of Search ..... 420/547, 546, 544, 543, 420/535, 534, 533, 532; 148/415-417, 437-440

[56] References Cited

U.S. PATENT DOCUMENTS 4,847,048 7/1989 Nishi et al. ..... 420/547

*Primary Examiner*—R. Dean

*Attorney, Agent, or Firm*—Sughrue, Mion, Zinn, Macpeak & Seas

[57] ABSTRACT

An aluminum alloy composition represented by the following general formula (I):

$$Al_aMg_bNi_cMn_dSi_eCu_fFe_gTi_hZn_iB_kZr_l \quad (I)$$

wherein b=about 2-8 wt %
c=0-about 7 wt %
d=0-about 3.0 wt %
e=0-about 1.0 wt %
f=0-about 1.0 wt %
g=0-about 0.5 wt %
h=0-about 0.3 wt %
i=0-about 0.3 wt %
j=0-about 0.1 wt %
k=0-about 0.1 wt % and
l=0-about 0.3 wt %; provided that
c+d≧about 0.5 wt %, and
a is balance.

7 Claims, 5 Drawing Sheets

(x500)

(x 500)

(x 500)

ALUMINUM DIE-CASTING ALLOYS

This is a continuation of application Ser. No. 076,435, filed July 21, 1987, now U.S. Pat. No. 4,874,048.

FIELD OF THE INVENTION

The present invention relates to an aluminum alloy, more particularly, to an aluminum die-casting alloy having great toughness and high resistance to wear and corrosion.

BACKGROUND OF THE INVENTION

Aluminum die-cast alloys have high dimensional accuracy and smooth and attractive casting surfaces in the as-cast condition. In addition, they can be produced in large quantities in a rapid operation. Therefore, aluminum die-cast alloys are extensively used as daily necessities, machine parts, etc.

Conventional aluminum die-casting alloys are based on Al-Si (JIS-ADC1), Al-Si-Cu (ADC10, ADC12), Al-Si-Mg (ADC3) and Al-Mg (ADC5) systems and aluminum alloys containing 7.5–13 wt % Si are used most commonly in die-casting (The term "JIS" as used herein refers to a "Japanese Industrial Standard"). The alloying of aluminum with silicon provides various advantages such as improving fluidity, reducing solidification shrinkage, decreasing the thermal expansion coefficient, and improving wear resistance. However, aluminum alloyed with silicon is very low in elongation and impact resistance (toughness) because silicon is brittle and the silicon in the eutectic crystals of Al-Si grow in the form of long needles.

As modern engineering products have gained ever higher performance levels and as their ranges of application have expanded, an increasing number of customers have required die-cast products having improved mechanical strength and toughness, and these requirements cannot be fully met by the usual practice of adjusting the composition of JIS alloys or incorporating certain technical improvements in the casting process. Protective automotive parts are required to have high toughness and, conventionally their specified quality is attained by performing a $T_6$ tempering (heat treatment) on castings of Al-Si-Mg and other AC4C alloys (aluminum casting alloys) specified in JIS having comparatively high toughness. However, performing heat treatments after casting is highly inefficient and undesirably increases product costs. Conventionally used Al-Si-Cu alloys do not have high toughness, since tabular eutectic Si crystals form upon solidification, and these alloys are not suitable for use in protective parts which are required to have high toughness. Under these circumstances, it is desired to develop casting alloys that exhibit high strength and toughness in the as-cast condition.

The aluminum alloys of ADC5 and ADC6 type are widely used in castings where high corrosion resistance is required and as alloys for making Alumite having oxidation protecting film formed by anodic oxidation. Binary Al-Mg alloys have high corrosion resistance comparable to that of engineering pure aluminum but they experience seizure in or welding to dies extensively and, because of alloying with magnesium, the range of temperatures at which these alloys solidify is expanded to cause cracking and reduced hot fluidity. In practical applications, up to 1% Si and trace amounts of Mn and Fe are added to ADC6 so as to improve its castability and strength.

As for ADC,5, seizure in dies is inhibited by addition of up to 1.8% Fe, so that this alloy can be die-cast.

As described above, in order to improve castability and strength without sacrificing corrosion resistance, commercial Al-Mg base die-casting alloys contain comparatively small amounts of elements such as Si, Fe and Mn, either independently or in combination. However, these alloys are principally intended to be used in applications where high corrosion resistance is required and their tensile strength, yield point and modulus are generally low as compared with ADC10 and ADC12. Therefore, these alloys, which can be used in ornamental parts such as cases and covers, find limited use as structural materials.

Aluminum alloys containing 7.5–13 wt % Si such as JIS ADC1 (Al-Si type), ADC10, ADC12 and ADC3 (Al-Si-Mg type) are sometimes anodized and used in sliding members such as pistons and cylinder liners. However, because silicon is a strong current retarding element, the formation of a desired anodic oxide film will not proceed unless desiliconization is effected, such as by pickling, or anodization is performed with specific waveforms of electric current. It is therefore a very difficult task which requires complicated procedures to provide Si-containing aluminum alloys with anodic films that are 20–30 μm thick, in which range they exhibit particularly high wear resistance.

SUMMARY OF THE INVENTION

The principal object of the present invention is to overcome the aforementioned problems, and by selecting appropriate components to be incorporated in combination in binary Al-Mg alloys, the present inventors have succeeded in developing aluminum die-casting alloys having great toughness and high resistance to wear and corrosion.

According to the present invention there is to provide an aluminum alloy composition represented by the following general formula (I):

$$Al_aMg_bNi_cMn_dSi_eCu_fFe_gTi_hZn_iB_kZr_l \quad (I)$$

wherein b=about 2–8 wt %
c=0–about 7 wt %
d=0–about 3.0 wt %
e=0–about 1.5 wt %
f=0–about 1.0 wt %
g=0–about 0.5 wt %
h=0–about 0.3 wt %
i=0–about 0.3 wt %
k=0–about 0.1 wt %
l=0–about 0.3 wt %; provided that
c+d>about 0.5 wt %, and
a is balance

DETAILED DESCRIPTION OF THE INVENTION

Figure 1:
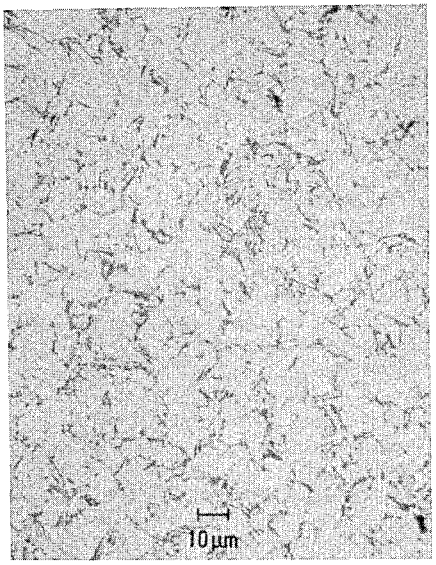
FIG. 1 is an optical micrograph (500X) showing the solidification structure of a high-toughness aluminum die-casting alloy according to the present invention.

The aluminum alloy according to the first aspect of the present invention contains about 2–5.5 wt % Mg, about 0.5–2.5 wt % Mn, about 1–5.5 wt % Ni, the balance being Al, and Cu optional amounts of up to about 0.5 wt %, Si up to about 0.5 wt %, and Zn up to about 0.3 wt %. If desired, this alloy may additionally contain about 0.01–0.3 wt % Ti and about 0.001–0.1 wt % B.

Magnesium dissolves in the aluminum matrix and increases the tensile strength, yield point and hardness of the alloy through solid solution strengthening. If the content of Mg is less than about 2 wt %, the desired strength is not attained, and if its content exceeds about 5.5 wt %, magnesium undergoes extensive segregation to form an Al-Mg base compound which is detrimental to the mechanical properties of the alloy.

Manganese forms a compound with Al or with Ni and Al so as to improve the strength, hardness and modulus of the alloy. If the content of Mn is less than about 0.5 wt %, the intended effect is not fully attained, and if its content exceeds about 2.5 wt %, Mn forms coarse crystals that decrease toughness and increase the chance of hot-cracking of the alloy.

Nickel forms a compound with Al or with Mn and Al so as to improve the strength of the alloy. Nickel also contributes to improvements in resistance to hot-cracking and in fluidity of molten alloy. If the content of Ni is less than about 1 wt %, these effects are not fully attained and if the Ni content exceeds about 5.5 wt %, coarse Al-Ni base crystals will form to decrease toughness.

Titanium when added in combination with B is very effective for grain refinement and thereby contributes to improvement of castability. The effect is small if the contents of Ti and B are less than about 0.01 wt % and about 0.001 wt %, respectively. If the respective contents exceed about 0.3 wt % and about 0.1 wt %, undesirable compounds will be formed that reduce toughness.

The aluminum alloy according to the second aspect of the present invention contains about 4–7 wt % Ni, about 3–7 wt % Mg, and up to about 1.0 wt % S up to about 1.0 wt % Cu, up to about 0.5 wt % Fe and up to about 0.5 wt % Mn, with the balance being Al.

The aluminum alloy according to the third aspect of the present invention is the same as above except that it additionally contains up to about 0.2 wt % Ti.

(1) Ni

Nickel added to the aluminum matrix forms an intermetallic compound $NiAl_3$ At 5.7 wt % Ni, this compound forms a eutectic alloy and is dispersed in the form of very fine grains. If the addition of Ni greatly exceeds 5.7 wt %, aggregate or tabular proeutectic alloys of $NiAl_3$ will be formed to reduce toughness. Therefore, the Ni content is controlled to be no more than about 7 wt %. If the Ni content is less than about 4 wt %, the desired mechanical properties will not be attained.

(2) Mg

Magnesium dissolves well in the aluminum matrix and contributes its solid solution strengthening effect. The Mg content of the alloy is controlled to be within the range of about 3–7 wt %. The solid solution strengthening effect of Mg is small if its content is less than about 3 wt %. Addition of more than about 7 wt % Mg causes a significant drop in elongation.

(3) Ti

Titanium is not present in the aluminum alloy of the second aspect but is incorporated in the alloy of the third aspect. Addition of up to about 0.2 wt % Ti is effective in improving castability and refining crystal grains but if it is added in an amount exceeding about 0.2 wt %, an intermetallic compound $TiAl_3$ will crystallize.

(4) Si, Cu, Fe, Mn, etc.

Silicon, copper, iron and manganese, may be present in the following amounts: Si up to about 1.0 wt %; Cu up to about 1.0 wt %; Fe up to about 0.5 wt %; and Mn up to about 0.5 wt %. Other incidental impurities resulted from smelting and refining process may also be present to an extent that will not alter the compositional ranges specified by the present invention.

In a preferred embodiment, the aluminum die-casting alloy according to the second or third aspect of the present invention is cast and anodized to form a hard oxide film on the surface of the casting. (JISH9500) This oxide film is very hard and has excellent wear resistance. More specifically, the aluminum alloy is die-cast, and anodized with sulfuric acid or a mixture of sulfuric acid and oxalic acid used as an electrolyte bath, so as to form a hard oxide film about 20–30 μm thick on the surface of the casting. This anodic film imparts a very high hardness (Hv=about 150–285) to the cast part.

The aluminum alloy according to the fourth aspect of the present invention contains about 4.5–8 wt % Mg to about 1.8–3.0 wt % Mn and up to about 1.5 wt % Si, the balance being Al and, if desired, this alloy may additionally contain at least one of about 0.01–0.3 wt % Ti, about 0.001–0.1 wt % B and about 0.01 to 0.3 wt % Zr.

If manganese is added to an Al-Mg base alloy in an approximate amount of 2 wt %, in the vicinity of which a eutectic composition will occur, an intermetallic compound $Al_6Mn$ forms in the alloy to improve its tensile strength and modulus. The corrosion resistance of the alloy is also improved since Fe and other elements that reduce corrosion resistance are dissolved in $Al_6Mn$. The addition of Mn is also effective in improving the castability of the Al-Mg base alloy. These effects are not achieved if the Mn content is less than about 1.8 wt %. If the Mn content exceeds about 3.0 wt %, coarse proeutectic grains of $Al_6Mn$ will crystallize to impair the mechanical properties and machinability of the alloy. Therefore, the Mn content is controlled to be in the range of about 1.8–3.0 wt %.

The addition of Mg is effective in increasing the hardness and strength of the alloy without sacrificing its corrosion resistance. However, if the addition of Mn is less than about 4.5 wt %, the desired strength will not be attained, and if its content exceeds about 8 wt %, Mg will undergo extensive segregation to form an Al-Mg base compound and the mechanical properties of the alloy will be impaired.

Titanium, when added in combination with B, is very effective for grain refinement and thereby contributes to improvement of castability. The effect is small if the contents of Ti and B are less than about 0.01 wt % and about 0.001 wt %, respectively. If the respective contents exceed about 0.3 wt % and about 0.1 wt %, brittle compounds will form to reduce toughness.

Zirconium is also a grain refining element and is effective for providing improved castability, in particular increased resistance to hot-cracking of the alloy. This effect is not attained if the Zr content is less than about 0.01 wt %. If more than about 0.3 wt % Zr is present, an Al-Zr base compound will form to impair the mechanical properties of the alloy.

As described above, the high-toughness aluminum die-casting alloy according to the first aspect of the present invention contains Mn and Ni in combination in a binary Al-Mg alloy and exhibits excellent mechanical strength and toughness in the as-cast condition. These properties are superior to those of conventional aluminum die-casting alloys, and permit this alloy to be used in casting structural protective parts that are required to have high toughness. As a further advantage, the cast part need not be subjected to any heat treatment as required for conventional alloys, and this contributes to a reduction in the cost of the final product.

The alloy according to the second aspect of the present invention is made of a ternary Al-Ni-Mg system and compared with conventional aluminum die-casting alloys, this alloy not only has high tensile strength, yield point at 0.2%, and elongation but also has a high impact value, and thereby affords a very high level of toughness. The alloy therefore finds extensive use as a material for making structural parts that are required to have high toughness.

The alloy according to the third aspect of the present invention additionally contains Ti, in addition to the properties described above, this alloy has even better castability due to refined crystal grain structure.

The high-toughness Al-Ni-Mg alloy according to the second aspect, or the high-toughness Al-Ni-Mg-Ti alloy according to the third aspect, of the present invention may be anodized to form a hard oxide film on its surface. In a typical case, this anodic film suitably has a thickness of about 21.3 μm, a Vickers hardness (Hv) of about 280, and a specific wear of about $1.8\text{–}2.0\times10^{-7}$ $mm^2/kg$. Because of this highly wear-resistant oxide, these alloys are suitable for use as materials for fabricating sliding members such as pistons and cylinder liners. In addition, these alloys can be shaped into such members by a simple method of die-casting.

In the absence of Si, which has a strong current retarding effect, these alloys of Al-Ni-Mg and Al-Ni-Mg-Ti systems can be readily anodized with DC current without any preliminary washing or pickling treatment. Therefore, any desired parts can be fabricated from these alloys at a greatly reduced cost. Furthermore, maximum wear resistance can be attained by a thin (21.3 μm) anodic film, and greater thickness such as about 40–70 μm, is not necessary. Such a thin film can be formed anodization at a current density of about 1 $A/dm^2$ for a period of about 60 minutes or at about 2 $A/dm^2$ for about 30 minutes, and this also contributes to a reduction in the manufacturing cost of the final product.

The aluminum die-casting alloy according to the fourth aspect of the present invention not only has high corrosion resistance but also exhibits a better tensile strength and yield point than the prior art corrosion-resistant aluminum die-casting alloy. Therefore, this alloy can be used in a broad range of applications as structural and exterior parts where high corrosion resistance and strength are required.

Preferable aluminum alloy compositions are illustrated as shown below.

(1)

Mg: 3.0–4.5%
Ni: 2.2–3.0%
Mn: 0.8–1.4%
Si: Not more than 0.3%
Cu: Not more than 0.2%
Fe: Not more than 0.3%
Zr: Not more than 0.2%
Ti: 0.05–0.1%
B: 0.001–0.005%
Al: Balance (2)

Mg: 4.5–5.5%
Ni: 5.0–6.0%
Mn: Not more than 0.1%
Si: Not more than 0.2%
Cu: Not more than 0.1%
Fe: Not more than 0.2%
Zr: Not more than 0.1%
Ti: Not more than 0.1%
Al: Balance (3)

Mg; 4.0–5.5%
Ni: Not more than 0.1%
Mn: 1.0–2.0%
Si: 0.5–1.0%
Cu: Not more than 0.1%
Fe: Not more than 0.3%
Zr: Not more than 0.3%
Ti: 0.05–0.1%
Al: Balance The present invention is hereinafter described in greater detail with reference to examples, which are not to be construed as limiting the scope thereof. Unless otherwise indicated, all parts, percents and ratios are by weight.

EXAMPLE 1

Molten alloys having the compositions indicated in Table 1 were cast in a 90-t die-casting machine under the following conditions: pouring temperature, 73017°–750° C.; die temperature, 110°–150° C.; injection speed, 1.3–1.5 m/sec; pour pressure, 790 $kgf/cm^2$; and chill time, 5 sec. The resulting cast parts were designated sample Nos. 1–19. A reference sample was cast from JIS ADC10 under the same conditions.

All samples were subjected to the following tests, the results of which are summarized in Table 2.

(1) Tensile test

The as-cast samples were shaped according to the ASTM specifications for tensile testing and thereafter were subjected to a standard tensile test.

(2) Hardness test

The as-cast samples were shaped to 6.35 mm×6.35 mm×10 mm and subjected to standard measurement of Vickers hardness (Hv) under a load of 200 g.

(3) Impact test

The as-cast samples were shaped to have square surfaces (6.35 mm×6.35 mm) and subjected to a standard charpy impact test.

TABLE 1

(wt %)

| Sample No. | Mg | Mn | Ni | Si | Fe | Ti | B | Be | Al | Remarks |
|---|---|---|---|---|---|---|---|---|---|---|
| 1 | 0.01 | 2.0 | 2.78 | 0.03 | 0.13 | — | — | — | Bal. | Comparison |
| 2 | 0.68 | 1.83 | 4.72 | 0.21 | 0.31 | — | — | — | " | " |
| 3 | 1.96 | 2.13 | 3.02 | 0.09 | 0.16 | — | — | — | " | " |
| 4 | 2.23 | 1.83 | 5.17 | 0.17 | 0.14 | — | — | — | " | Present Invention |
| 5 | 4.04 | 1.87 | 2.95 | 0.28 | 0.12 | — | — | — | " | Present Invention |
| 6 | 4.86 | 2.99 | 3.93 | 0.03 | 0.10 | — | — | — | " | Comparison |
| 7 | 4.95 | 0.74 | 3.02 | 0.13 | 0.09 | — | — | — | " | Present Invention |
| 8 | 4.98 | 0.95 | 0.95 | 0.18 | 0.14 | — | — | — | " | Comparison |
| 9 | 5.00 | 2.78 | 2.98 | 0.30 | 0.12 | — | — | — | " | " |
| 10 | 5.04 | 1.91 | 4.86 | 0.09 | 0.11 | — | — | — | " | Present Invention |
| 11 | 5.05 | 2.03 | 1.02 | 0.12 | 0.11 | — | — | — | " | Present Invention |
| 12 | 5.07 | 0.99 | 2.04 | 0.02 | 0.15 | — | — | — | " | Present Invention |
| 13 | 5.09 | 2.27 | 2.01 | 0.12 | 0.14 | — | — | 0.003 | " | Present Invention |
| 14 | 5.21 | 2.29 | 2.92 | 0.06 | 0.01 | 0.16 | 0.005 | — | " | Present Invention |
| 15 | 5.14 | 0.93 | 4.04 | 0.01 | 0.17 | — | — | — | " | Present Invention |
| 16 | 5.14 | 2.46 | 5.96 | 0.10 | 0.13 | — | — | — | " | Comparison |
| 17 | 2.62 | 0.41 | 1.23 | 0.14 | 0.11 | | | | " | " |
| 18 | 5.60 | 2.31 | 5.41 | 0.10 | 0.09 | | | | " | " |
| 19 | 6.97 | 2.07 | 2.98 | | | | | | " | " |
| Commercial Alloy ADC10 | <0.3 | <0.5 | <0.5 | 7.5~9.5 | <1.3 | | | | " | Cu 2.2~4.0 Zn < 1.0 Sn < 0.3 |
| Commercial Alloy AC4C | 0.25~0.45 | <0.35 | <0.10 | 6.5~4.5 | <0.55 | <0.2 | | | " | Cu < 0.25 Zn < 0.35 |

TABLE 2

| Sample No. | Tensile strength ($kgf/mm^2$) | Tensile test yield point ($kgf/mm^2$) | Elongation (%) | Impact value ($kgm/cm^2$) | Hardness Hv (200 g) | Remarks |
|---|---|---|---|---|---|---|
| 1 | 25.4 | 14.6 | 14.9 | — | 79 | Comparison |
| 2 | 29.2 | 16.2 | 8.2 | 3.0 | 96 | " |
| 3 | 31.9 | 17.3 | 10.8 | — | 91 | " |
| 4 | 35.7 | 19.3 | 9.7 | 2.2 | 120 | Present Invention |
| 5 | 34.4 | 18.7 | 7.5 | — | 105 | Present Invention |
| 6 | 36.8 | 22.4 | 3.0 | 1.5 | 137 | Comparison |
| 7 | 33.2 | 19.0 | 7.9 | 2.8 | 113 | Present Invention |
| 8 | 31.7 | 15.7 | 16.7 | 5.9 | 105 | Comparison |
| 9 | 35.8 | 20.9 | 3.9 | 1.5 | 135 | " |
| 10 | 37.1 | 22.0 | 4.4 | 1.3 | 152 | Present Invention |
| 11 | 33.9 | 18.5 | 11.8 | 3.2 | 108 | Present Invention |
| 12 | 34.2 | 18.6 | 13.5 | 3.7 | 121 | Present Invention |
| 13 | 33.7 | 18.7 | 8.6 | 2.7 | 114 | Present Invention |
| 14 | 35.7 | 19.6 | 7.7 | 2.5 | 122 | Present Invention |
| 15 | 34.8 | 19.0 | 7.3 | 2.2 | 123 | Present Invention |
| 16 | 36.9 | 22.0 | 1.9 | — | 142 | Comparison |
| 17 | 23.7 | 12.2 | 15.7 | — | 71 | " |
| 18 | 36.1 | 23.0 | 2.6 | 1.0 | 134 | " |
| 19 | 33.8 | 23.4 | 1.5 | — | 130 | " |
| Commercial Alloy ADC10 | 30.5~32.6 | 17.6 | 1.5~4.0 | 0.9~1.0 | 80~100 | Reference |
| Commercial | 30.6 | 17.8 | 7.2 | 2.2 | 93 | |

TABLE 2-continued

| Sample No. | Tensile strength (kgf/mm$^2$) | Tensile test yield point (kgf/mm$^2$) | Elongation (%) | Impact value (kgm/cm$^2$) | Hardness Hv (200 g) | Remarks |
|---|---|---|---|---|---|---|
| Alloy AC4C | | | | | | |

The data in Table 2 show that the samples of the present invention were comparable to or better than $ADC_{10}$ in terms of tensile strength and yield point; and with respect to elongation and impact value, the samples of the present invention were better than $ADC_{10}$ by factors of at least 3 and 1.5, respectively.

The Vickers hardness of $ADC_{10}$ was no higher than 100 but the samples of the present invention had Hv values of 100 and more. It is therefore evident that the alloy of the present invention is also better than the conventional aluminum die-casting alloy $ADC_{10}$ in terms of hardness.

FIG. 1 is an optical micrograph (500X) showing the solidification structure of an alloy of the present invention that consisted of 5.09 wt % Mg, 2.27 wt % Mn, 2.01 wt % Ni, the balance being Al. As is clear from this micrograph, the alloy was composed of fine and uniformly distributed needles of an intermetallic Al-Ni-Mn base compound and an Al matrix in which Mg was dissolved. The darker colored portions of the micrograph show the intermetallic Al-Ni-Mn compound and the lighter colored portions show the Al matrix in which Mg was dissolved.

EXAMPLE 2

Molten alloys having the compositions indicated in Table 3 were cast in a 90-t die-casting machine under the following conditions: pouring temperature, 710°–730° C.; die temperature, 110°–150° C.; injection speed, 1.3–1.5 m/sec; pour pressure, 790 kg/cm$^2$; and chill time, 5 sec. The resulting cast parts were designated sample Nos. 1–15. Under the same conditions, reference samples were cast from alloys of JIS ADC10 and the aluminum for die-casting wheels disclosed in Japanese Patent Publication No. 43539/1984.

All samples were subjected to the following microscopic examination and tests, the results of which are summarized in Table 4.

(1) Examination of solidification structure

Figure 2:
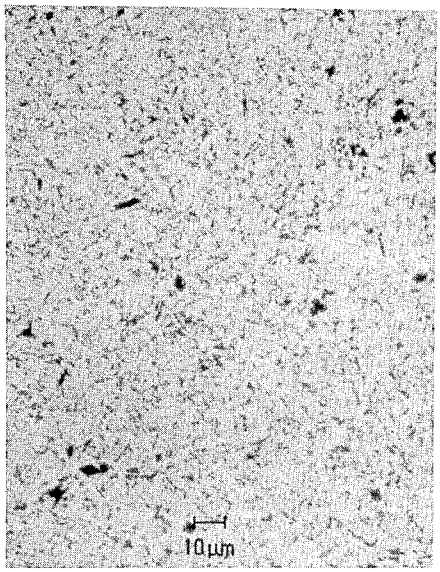
FIG. 2 is an optical micrograph (500X) showing the metallic structure of aluminum alloy prepared as sample No. 10 in Example 2 according to the present invention.

FIG. 2 is an optical micrograph (1000X) showing the solidification structure of sample No. 10 of the present invention. This alloy was composed of finely dispersed grains of $NiAl_3$ and an Al matrix in which Mg was dissolved, with partial crystallization of an intermetallic compound of Al and Mg.

(2) Tensile test

The as-cast samples were shaped according to the ASTM specifications for tensile testing and thereafter subjected to a standard tensile strength test.

(3) Hardness test

The as-cast samples were shaped to 6.35 mm×6.35 mm×10 mm and subjected to standard measurements of Vickers hardness (Hv) under a load of 200 g.

(4) Impact test

The as-cast samples were shaped to have square surfaces (6.35 mm×6.35 mm) and subjected to a standard Charpy impact test.

TABLE 3

| Sample Nos. | Compositions (wt %) Ni | Mg | Ti | Si | Fe | Mn | Cu | Al | Remarks |
|---|---|---|---|---|---|---|---|---|---|
| 1 | 5.01 | 2.23 | — | trace | 0.12 | trace | trace | balance | Comparison |
| 2 | 4.92 | 3.15 | — | 0.01 | 0.11 | trace | 0.01 | balance | Present Invention |
| 3 | 5.03 | 5.94 | — | 0.02 | 0.12 | trace | 0.01 | balance | Present Invention |
| 4 | 4.96 | 8.36 | — | 0.01 | 0.10 | trace | 0.01 | balance | Comparison |
| 5 | 2.71 | 5.34 | — | trace | 0.09 | trace | trace | balance | " |
| 6 | 6.24 | 5.09 | — | 0.03 | 0.14 | trace | trace | balance | Present Invention |
| 7 | 8.66 | 5.22 | — | 0.21 | 0.10 | trace | 0.01 | balance | Comparison |
| 8 | 4.95 | 2.31 | 0.13 | trace | 0.12 | trace | 0.08 | balance | " |
| 9 | 4.96 | 3.29 | 0.12 | 0.06 | 0.13 | trace | trace | balance | Present Invention |
| 10 | 5.11 | 5.93 | 0.14 | 0.02 | 0.11 | trace | 0.01 | balance | Present Invention |
| 11 | 4.92 | 8.90 | 0.11 | 0.24 | 0.02 | trace | trace | balance | Comparison |
| 12 | 5.45 | 6.37 | 0.33 | 0.08 | 0.18 | trace | 0.04 | balance | " |
| 13 | 2.61 | 5.10 | 0.13 | 0.05 | 0.13 | trace | 0.01 | balance | " |
| 14 | 6.31 | 5.12 | 0.11 | 0.13 | 0.17 | trace | 0.03 | balance | Present Invention |
| 15 | 8.74 | 5.21 | 0.12 | 0.03 | 0.16 | trace | 0.02 | balance | Comparison |
| Commercial alloy ADC10 | ≦0.5 | 0.3 | — | 7.5~9.5 | ≦1.3 | ≦0.5 | 2.0~4.0 | balance | (Sn < 0.3) (Zn < 1.0) Reference |
| Alloy disclosed in Jap. Pat. Publn. No. 43539/84 | — | 0.2~0.4 | — | 7.5~9.0 | 0.2~0.7 | 0.3~0.4 | <0.05 | balance | Zn < 1.0 Reference |

TABLE 4

| Sample No. | Tensile Strength: Tensile strength (kgf/mm²) | Tensile Strength: 0.2% Yield strength (kgf/mm²) | Tensile Strength: Elongation (%) | Vickers hardness (Hv) | Charpy impact value (kgf.m/cm²) | Remarks |
|---|---|---|---|---|---|---|
| 1 | 27.5 | 16.6 | 13.9 | 81 | 3.46 | Comparison |
| 2 | 32.6 | 19.5 | 11.5 | 103 | 3.28 | Present Invention |
| 3 | 34.5 | 20.3 | 10.8 | 117 | 2.61 | Present Invention |
| 4 | 36.5 | 22.7 | 4.1 | 121 | 0.64 | Comparison |
| 5 | 31.5 | 19.5 | 11.6 | 86 | 3.23 | " |
| 6 | 34.2 | 20.1 | 10.2 | 115 | 3.01 | Present Invention |
| 7 | 31.6 | 21.2 | 4.2 | 114 | 1.56 | Comparison |
| 8 | 28.1 | 10.9 | 13.6 | 83 | 3.49 | " |
| 9 | 32.1 | 19.8 | 12.0 | 103 | 3.34 | Present Invention |
| 10 | 35.1 | 20.8 | 8.2 | 120 | 2.50 | Present Invention |
| 11 | 36.9 | 23.0 | 3.9 | 123 | 0.63 | Comparison |
| 12 | 34.5 | 19.9 | 0.1 | 100 | 1.92 | " |
| 13 | 31.7 | 19.2 | 11.1 | 87 | 3.31 | " |
| 14 | 34.6 | 20.1 | 10.0 | 117 | 2.92 | Present Invention |
| 15 | 31.4 | 21.5 | 4.1 | 118 | 1.63 | Comparison |
| ADC10 | 30.5~32.6 | 17.6 | 1.5~4 | 80~100 | 0.9~1.0 | Reference |
| Alloy disclosed in Jap. Pat. Publn. No. 43539/84 | 26~29.5 | 12~14 | 6~9 | 81~86 | 1.63~1.68 | Reference |

As the data in Table 4 show, the samples of the present invention were comparable to or better than JIS ADC10 in terms of tensile strength; the yield points at 0.2% of these samples were higher than that of ADC10 by 2.4–3.4 kgf/mm²; the elongation of the samples was better than that of ADC10 by factors of 3–8 and comparable to or better than the alloy shown in Japanese Patent Publication No. 43539/1984. It is therefore clear that the alloy of the present invention is superior to these alloys in terms of both strength and elongation.

The Vickers hardness (under 200-g load) of each of the reference samples was no higher than 100 but the samples of the present invention had Hv values of 100 and more. This shows the higher wear resistance of the alloy of the present invention.

The alloy samples of the present invention had much higher Charpy impact values than the reference samples, i.e., 2.5–3.7 times as high as ADC10 and 1.5–2 times as high as the alloy disclosed in Japanese Patent Publication No. 43539/1984.

EXAMPLE 3

A molten alloy having the composition shown in Table 5 was deoxidized at 750° C. and cast with a 90-t die-casting machine to make a sample measuring 6.35×35×210 mm. This sample was cut into three equal portions, each being worked to a size of 6.35×6.35×70 mm and anodized Casting of conventional aluminum die-casting alloys, e.g., ADC10, 390 and ADC6. are usually anodized after the following preliminary treatments: degreasing with trichloroethane, washing with 10% NaOH, pickling with 15% HNO+1% HF, and washing with water.

A casting of the alloy of the present invention simply requires degreasing with trichloroethane as a preliminary treatment for anodization, and it does not have to be washed with NaOH or water, or pickled.

The samples were anodized by the sulfuric acid method under the conditions shown below. The casting of the alloy of the present invention could be anodized with a dc current but the castings of the conventional die-casting alloys had to be anodized with varying current waveforms. (JIS H 9500)

Anodizing Conditions

Electrolyte: 15% $H_2SO_4$
Temperature: 15° C.
Current density: 1–3 A/dm²
Time: 20–60 min Table 6 shows the effects of anodizing conditions (current density and time) on the thickness of anodiz films formed on the castings of the alloy of the present invention and conventional aluminum die-casting alloys, ADC6 and ADC10. As is clear from Table 6, the casting of the alloy of the present invention allowed thicker anodic films to be formed in shorter periods than the castings of the conventional alloys. For instance, an anodic film 6.7 μm thick was formed on the casting of ADC10 by anodization at 1 A/dm² for 30 minutes but under the same conditions, a film about 1.5 times as thick could be formed on the casting of the alloy of the present invention.

Figure 3:
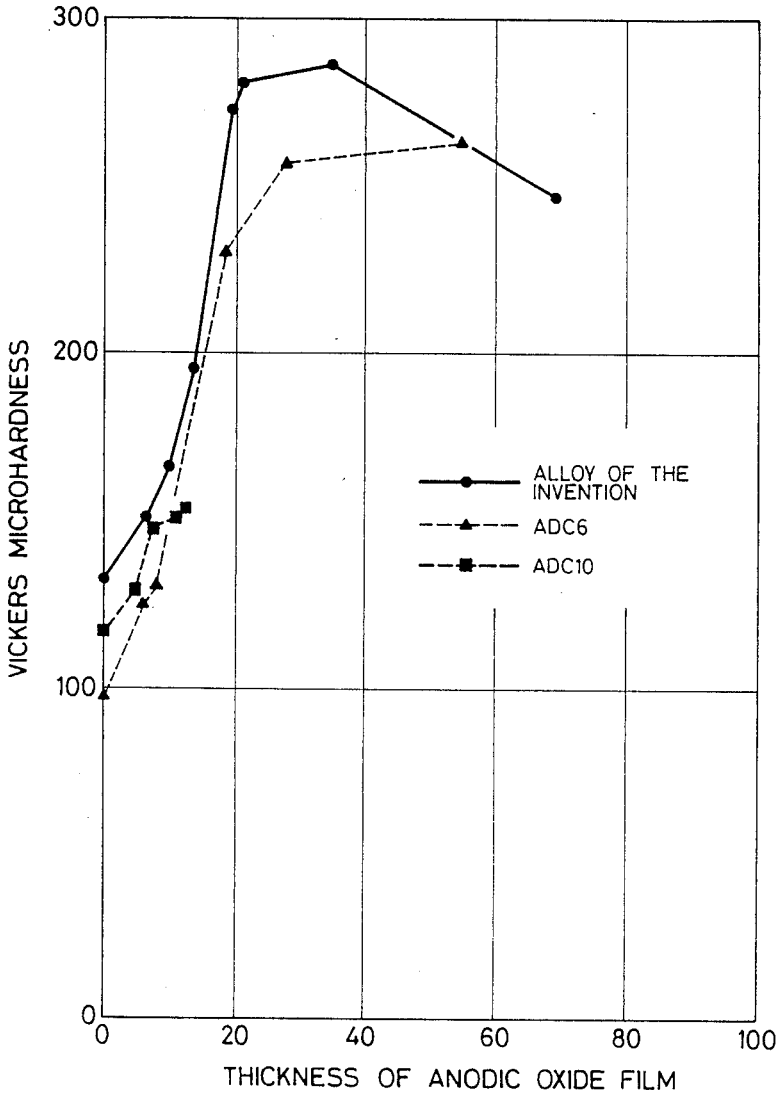
FIG. 3 is a graph showing the relationship between the thickness of anodic oxide films and their Vickers microhardness for an anodized casting of a hightoughness aluminum alloy according to the present invention and anodized castings of comparison alloys.

Table 7 shows the results of measurement of the hardness of anodic films as formed under varying anodization conditions. Hardness measurements were conducted with a Vickers microhardness meter under a load of 200 g. The relationship between the thickness of anodic films and their Vickers microhardness (Hv) is depicted in FIG. 3.

As Table 6 shows, the anodized casting of the alloy of the present invention had much higher values of Vickers hardness than the untreated surface (Hv=131). FIG. 3 clearly shows that the anodic films 20–34.7 μm thick were about twice as hard as the untreated surface. However, as the film thickness exceeded 34.7 μm, the hardness decreased and 70 μm, the film became porous and had a very low hardness. The anodic film formed on the casting of the alloy of the present invention by anodization at 1 A/dm$^2$ for 60 minutes had a Hv of 280 which was much higher than the value for ADC6 (Hv=230). This clearly shows the high wear resistance of the anodized casting of the alloy of the present invention.

Figure 4:
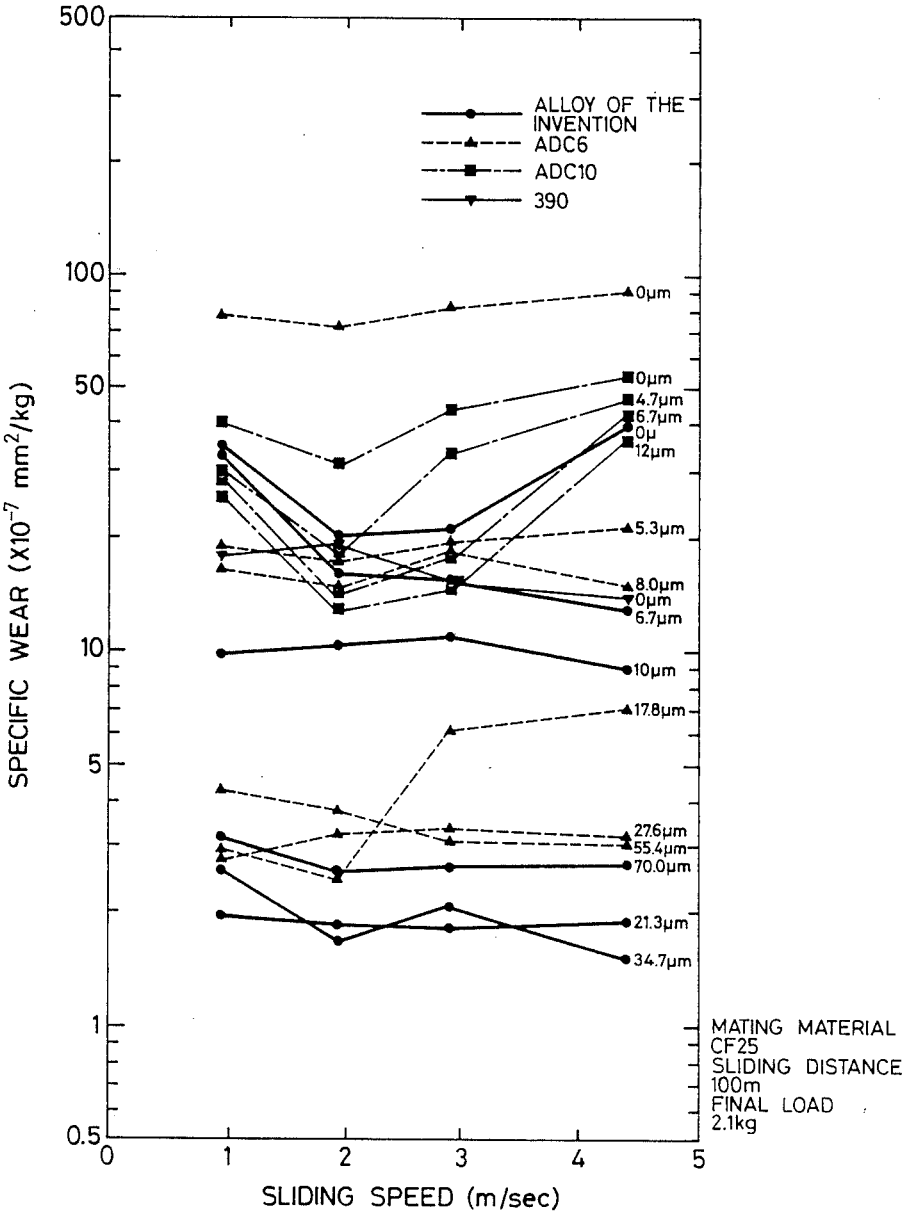
FIG. 4 is a graph showing the relationship between sliding speed and specific wear as obtained by performing a wear test on an anodized casting of the alloy according to the present invention and anodized castings of comparison alloys.

The results of a wear test conducted on the anodized casting of the alloy of the present invention and those of ADC6 and ADC10 are shown in Table 8 and FIG. 4. The test was performed using an Ohkoshi wear tester under an unlubricated condition for a final load of 2.1 kg and a sliding distance of 100 m, with the sliding speed varied at 0.94, 1.96, 2.84 and 4,36 m/sec. Determination of specific wear was made from the size of depression formed in the mating material Fc25. The test results for Alloy 390 (known wear-resistant aluminum alloy) are also shown in Table 8 for comparison.

TABLE 5

| Casting | Chemical composition of the speciments. (wt %) | | | | | | | | | |
|---|---|---|---|---|---|---|---|---|---|---|
| | Cu | Si | Hg | Zn | Fe | Mn | Ni | Ti | B | Al |
| Present Invention | 0.13 | 0.13 | 5.12 | Tr | 0.17 | Tr | 5.11 | 0.11 | 0.02 | Bal. |
| Commercial Alloy ADC6 | 0.09 | 0.87 | 3.65 | 0.22 | 0.56 | 0.55 | Tr | — | — | Bal. |
| Commercial Alloy ADC10 | 3.56 | 9.22 | 0.21 | 0.02 | 0.57 | 0.24 | 0.12 | — | — | Bal. |
| Commercial Alloy 390 | 4.35 | 17.5 | 0.23 | 0.31 | 0.17 | 0.27 | 0.11 | — | — | Bal. |

TABLE 6

| Castings | Current Density | | | | | | |
|---|---|---|---|---|---|---|---|
| | 1 A/dm$^2$ | | | | 2 A/dm$^2$ | 3 A/dm$^2$ | |
| | Treating time | | | | | | |
| | 20 | 30 | 40 | 60 | 30 | 30 | 60 |
| Present Invention | 6.7 μm | 10.0 μm | 13.6 μm | 21.34 μm | 20.0 μm | 34.7 μm | 70.0 μm |
| Commercial Alloy ADC6 | 5.3 μm | 8.0 μm | 11.5 μm | 17.4 μm | 17.8 μm | 27.6 μm | 55.4 μm |
| Commercial Alloy ADC10 | 4.7 μm | 6.7 μm | 8.3 μm | 11.6 μm | 12.0 μm | 11.7 μm | —* |

*Not forming acceptable film

TABLE 7

| Castings | Current Density | | | | | | | |
|---|---|---|---|---|---|---|---|---|
| | 1 A/dm$^2$ | | | | 2 A/dm$^2$ | 3 A/dm$^2$ | | |
| | Treating time | | | | | | | |
| | 20 | 30 | 40 | 60 | 30 | 30 | 60 | |
| Present Invention | 150 | 165 | 185 | 280 | 272 | 285 | 247 | 131 |
| Commercial Alloy ADC6 | 123 | 129 | 154 | 230 | 225 | 256 | 263 | 97 |
| Commercial Alloy ADC10 | 129 | 146 | 148 | 155 | 153 | 149 | * | 116 |
| Commercial Alloy 390 | — | — | — | — | — | — | — | 154 |

Surface Hardness [Micro-Vickers hardness (Hv)] 200 g Load.
*Not forming acceptable film

TABLE 8

| Abrasion | | | | | | |
|---|---|---|---|---|---|---|
| | Casting Present Invention Film thickness (μm) | | | | | |
| Abrasion rate (m/sec) | 0 | 6.7 | 10.0 | 21.3 | 34.7 | 70.0 |
| 0.94 | 34.2 | 32.0 | 10.0 | 2.0 | 2.6 | 3.2 |
| 1.96 | 19.7 | 15.7 | 10.1 | 1.8 | 1.7 | 2.5 |
| 2.84 | 20.2 | 15.2 | 11.0 | 1.8 | 2.0 | 2.6 |
| 4.36 | 41.9 | 13.0 | 9.0 | 1.9 | 1.5 | 2.7 |

TABLE 8-continued

| Abrasion | | | | | | |
|---|---|---|---|---|---|---|
| | Casting ADC6 Film thickness (μm) | | | | | |
| Abrasion rate (m/sec) | 0 | 5.3 | 8.0 | 17.8 | 27.6 | 55.4 |
| 0.94 | 79.8 | 18.6 | 16.4 | 3.0 | 2.8 | 4.4 |
| 1.96 | 73.4 | 17.5 | 14.9 | 2.5 | 3.2 | 3.8 |
| 2.84 | 83.0 | 19.7 | 18.4 | 6.3 | 3.4 | 3.1 |
| 4.36 | 92.6 | 21.4 | 14.7 | 7.1 | 3.2 | 3.2 |

| | Casting | |
|---|---|---|
| | ADC10 | 390 |
| Abrasion rate (m/sec) | Film thickness (μm) | |
| 0.94 | 39.0 | 29.9 | 27.8 | 25.8 | 18.2 |
| 1.96 | 31.0 | 17.8 | 13.0 | 12.5 | 19.0 |
| 2.84 | 44.3 | 32.6 | 17.6 | 14.2 | 15.5 |
| 4.36 | 54.1 | 47.9 | 42.0 | 35.8 | 13.5 |

Table 8 and FIG. 4 show that the specific wear of the anodized casting of the alloy of the present invention was about one tenth of the value for the as-cast condition (Hv=131) when the sliding speed was 1.96 m/sec and the anodic film thickness was 21.3 μm. It is therefore clear that the wear resistance of the alloy of the present invention can be appreciably improved by anodization. It is also clear that the contribution the film thickness makes to wear resistance becomes marked at 20 μm or more. However, the effect peaks at 34.7 μm and thicker films have decreased wear resistance.

The casting of the alloy of the present invention is also much more wear resistant than the casting of Alloy 390 which is a typical conventional wear-resistant aluminum alloy.

EXAMPLE 4

Molten alloys having the compositions indicated in Table 9 were cast in a 90-t die-casting machine under the following conditions: pouring temperature, 730°-750° C.; die temperature, 110°-150° C.; injection speed, 1.3-1.5 m/sec; pour pressure, 790 kgf/cm$^2$; and chill time, 5 sec. The resulting cast parts were designated sample Nos. 1-11. Under the same conditions, reference samples were cast from JIS ADC10 and ADC6

TABLE 9

| Sample No. | Composition (wt %) Mg | Mn | Si | Fe | Ti | B | Zr | Al | Remarks |
|---|---|---|---|---|---|---|---|---|---|
| 1 | 5.21 | 2.22 | 0.53 | 0.19 | — | — | — | balance | Present Invention |
| 2 | 6.15 | 2.05 | 0.15 | 0.10 | — | — | — | " | Present Invention |
| 3 | 7.28 | 2.04 | 0.09 | 0.16 | — | — | — | " | Present Invention |
| 4 | 7.98 | 2.06 | — | 0.06 | — | — | 0.15 | " | Present Invention |
| 5 | 5.08 | 2.47 | 0.19 | 0.13 | — | — | — | " | Present Invention |
| 6 | 5.23 | 1.85 | 0.26 | 0.11 | — | — | — | " | Present Invention |
| 7 | 5.05 | 1.97 | 0.02 | 0.05 | — | — | 0.13 | " | Present Invention |
| 8 | 2.93 | 2.16 | — | 0.18 | — | — | — | " | Comparison |
| 9 | 4.15 | 1.98 | 0.29 | 0.15 | — | — | — | " | " |
| 10 | 4.93 | 3.16 | 0.28 | 0.17 | — | — | — | " | " |
| 11 | 5.04 | 1.76 | 0.12 | 0.07 | — | — | — | " | " |
| Commercial alloy ADC6 | 2.5~4.0 | 0.4~0.6 | ≦1.0 | ≦0.8 | — | — | — | " | Cu ≦ 0.1 Zn ≦ 0.4 Ni ≦ 0.1 Sn ≦ 0.1 |
| Commercial alloy ADC10 | ≦0.3 | ≦0.5 | 7.5~9.5 | ≦1.3 | — | — | — | " | Cu 2.0~4.0 Ni ≦ 0.5 Zn ≦ 1.0 Sn ≦ 0.3 |

All samples were subjected to the following microscopic examination and tests, the results of which are summarized in Tables 10 and 11.

TABLE 10

| Sample No. | Test results: Tensile strength (kgf/mm$^2$) | Tensile test yield point (kgf/mm$^2$) | Elongation (%) | Modulus (as reference (kgf/mm$^2$) | Hardness Hv (200 g) | Remarks |
|---|---|---|---|---|---|---|
| 1 | 31.9 | 16.9 | 14.0 | 7023 | 101 | Present Invention |
| 2 | 34.2 | 18.4 | 12.1 | 6648 | 118 | Present Invention |
| 3 | 35.2 | 20.0 | 9.5 | 6870 | 109 | Present Invention |
| 4 | 35.1 | 19.9 | 8.7 | 7119 | 113 | Present Invention |
| 5 | 31.4 | 17.9 | 9.7 | 7142 | 97 | Present Invention |
| 6 | 30.8 | 17.6 | 10.9 | 7059 | 102 | Present Invention |
| 7 | 30.8 | 17.0 | 10.0 | 6892 | 102 | Present Invention |
| 8 | 26.5 | 13.9 | 16.0 | 7329 | 90 | Comparison |
| 9 | 29.1 | 15.6 | 13.1 | 6819 | 101 | " |
| 10 | 28.9 | 17.4 | 5.5 | 7361 | 99 | " |
| 11 | 30.7 | 16.3 | 16.5 | 6849 | 89 | " |
| Commercial Alloy ADC6 | 25.0~26.5 | 11.2~14.8 | 7.5~10 | 6870 | 74 | Reference |
| Commercial Alloy ADC10 | 30.5~32.6 | 17.6 | 1.5~4 | 7240 | 80~100 | " |

TABLE 11

| Sample No. | Test (hr) Results of Salt Spray Test (R.N.) 4 | 8 | 24 | 48 | 72 | 96 | Remarks |
|---|---|---|---|---|---|---|---|
| 1 | 9.8 | | 9.5 | 9.0 | 8 | 8 | Present Invention |
| 2 | 9.8 | 9.5 | 9.5 | 9.0 | 8 | 6 | Present Invention |
| 3 | 9.7 | 9.5 | 9.3 | 9.0 | 7 | 6 | Present Invention |
| 4 | 9.5 | 9.3 | 0 | 8 | 6 | 5 | Present Invention |
| 5 | 9.8 | 9.5 | 9.5 | 9.0 | 8 | 8 | Present Invention |
| 6 | 9.8 | 9.5 | 9.5 | 9.0 | 8 | 7 | Present |

TABLE 11-continued

| Sample No. | Test (hr) Results of Salt Spray Test (R.N.) 4 | 8 | 24 | 48 | 72 | 96 | Remarks |
|---|---|---|---|---|---|---|---|
| 7 | 9.8 | 9.5 | 9.5 | 9.0 | 8 | 7 | Invention Present Invention |
| ADC6 | 9.3 | — | — | — | — | — | Reference |
| ADC10 | 6 | — | — | — | — | — | " |

(1) Examination of solidification structure

Figure 5:
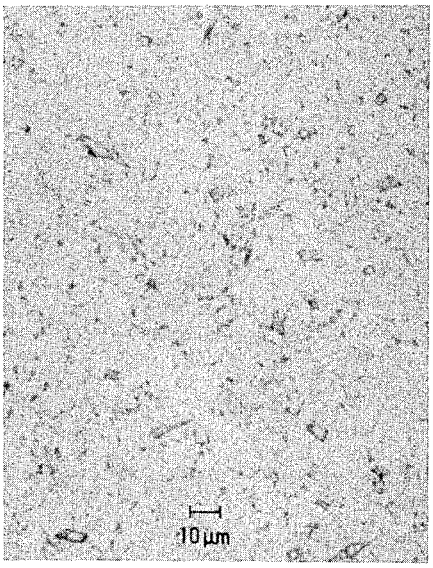
FIG. 5 is an optical micrograph (500X) showing the solidification structure of sample No. 2 that was cast in Example 4 from a high-toughness aluminum die-casting alloy according to the present invention.

FIG. 5 is an optical micrograph (500X) showing the solidification structure of sample No. 2 of the present invention. This alloy was composed of finely dispersed grains of an intermetallic $Al_6Mn$ compound and an Al matrix in which Mg was dissolved, with partial crystallization of an intermetallic compound of Al and Mg.

(2) Tensile test

The as-cast samples were shaped according to the ASTM specifications for tensile testing and thereafter subjected to a standard tensile test.

(3) Hardness test

The as-cast samples were shaped to 6.35 mm×6.35 mm×10 mm and subjected to standard measurements of Vickers hardness (Hv) under a load of 200 g.

(4) Accelerated corrosion test

The samples measuring 6.35 mm×6.35 mm×50 mm were subjected to accelerated corrosion by continuous spraying with a brine solution for 5.0%. The severity of corrosion occurring in the samples was evaluated in terms of rating number (R.N.).

The data in Table 10 show that the alloy samples of the present invention had tensile strengths and yield points comparable to or better than those of ADC10, and elongations 3–9 times as high as the values for ADC10, ADC6 and ADC10 had Hv values of no higher than 100 but all samples of the present invention, except sample No. 5, attained Hv values higher than 100, showing that the alloy of the present invention is also better than the conventional aluminum die-casting alloys in terms of hardness.

Table 11 shows that after 4 hours of salt spraying, ADC6 had a rating number of 9.3 whereas all of samples of the present invention had R.N values of 9.5 and higher. It is therefore clear that in terms of corrosion resistance, the alloy of the present invention is comparable to or better than the conventional corrosion-resistant aluminum die-casting alloy.

While the invention has been described in detail and with reference to specific embodiment thereof, it will be apparent to one skilled in the art that various changes and modifications can be made therein without departing from the spirit and scope thereof.

What is claimed is:

1. An aluminum die-casting alloy which comprises about 4 to about 7 wt % of Ni, about 3 to about 7 wt % Mg, balance Al and indispensible impurities.

2. The aluminum die-casting alloy as recited in claim 1, which further comprises 0.2 wt % or less of Ti.

3. The aluminum die-casting alloy as recited in claim 1, wherein said indispensible impurities are at least one member selected from the group consisting of about 1.0 wt % or less of Si, about 1.0 wt % or less of Cu, about 0.5 wt % or less of Fe and about 0.5 wt % or less of Mn.

4. The aluminum die-casting alloy as recited in claim 1, wherein said alloy comprises a finely dispersed $NiAl_3$ phase and an aluminum matrix forming solid solution with Mg.

5. An aluminum die-casting alloy which comprises about 1.8 to about 3.0 wt % of Mn, about 4.5 to about 8.0 wt % of Mg, about 1.5 wt % or less of Si, balance Al and indispensible impurities.

6. An aluminum die-casting alloy as recited in claim 5, which further comprises at least one member, selected from the group consisting of about 0.3 wt % or less of Ti, about 0.1 wt % or less of B and about 0.3 wt % or less of Zr.

7. An aluminum die-casting alloy as recited in claim 5, wherein said indispensible impurities are at least one member selected from the group consisting of about 1.0 wt % or les of Cu, about 0.5 wt % or less of Fe, about 0.3 wt % or less of Zn and about 0.3 wt % or less of Ni.

* * * * *